US006210238B1

(12) United States Patent
Akimoto et al.

(10) Patent No.: US 6,210,238 B1
(45) **Date of Patent: *Apr. 3, 2001**

(54) WIRE CONNECTION APPARATUS FOR SOLENOID-OPERATED VALVES

(75) Inventors: Takashi Akimoto; Masamichi Tajima, both of Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/421,327

(22) Filed: Oct. 18, 1999

Related U.S. Application Data

(63) Continuation of application No. 09/205,363, filed on Dec. 4, 1998, now Pat. No. 6,017,249.

(30) Foreign Application Priority Data

Dec. 26, 1997 (JP) ..... 9-368073

(51) Int. Cl.[7] ..... H01R 13/04

(52) U.S. Cl. ..... 439/692; 439/929; 439/748; 439/271; 439/378

(58) Field of Search ..... 439/692, 271, 439/378, 748, 929

(56) References Cited

U.S. PATENT DOCUMENTS

| | | | | |
|---|---|---|---|---|
| 2,762,026 | * | 9/1956 | Knohl | 439/748 |
| 4,664,456 | * | 5/1987 | Blair et al. | 339/14 |
| 4,671,600 | * | 6/1987 | Sawai et al. | 439/221 |
| 5,363,722 | | 11/1994 | Klotz . | |
| 5,777,850 | * | 6/1998 | Jakob et al. | 361/736 |
| 5,996,610 | * | 12/1999 | Sato et al. | 137/271 |
| 6,017,249 | * | 1/2000 | Akimoto et al. | 439/692 |
| 6,041,816 | * | 3/2000 | Hiramatsu et al. | 137/560 |

FOREIGN PATENT DOCUMENTS

| | | |
|---|---|---|
| 1 980 272 | 3/1968 | (DE) . |
| 84 18 488 | 9/1984 | (DE) . |
| 39 17 528 | 12/1990 | (DE) . |
| 297 18 245 U | 11/1997 | (DE) . |
| 2 698 492 | 5/1994 | (FR) . |

* cited by examiner

*Primary Examiner*—Paula Bradley
*Assistant Examiner*—Truc Nguyen
(74) *Attorney, Agent, or Firm*—Oblon, Spivak, McClelland, Maier & Neustadt, P.C.

(57) ABSTRACT

The present invention includes a terminal block accommodation chamber formed in a sub-plate, a cover member detachably mounted on the opening of the terminal block accommodation chamber, and a terminal block that is formed integrally with the cover member and that is loaded in and unloaded from the terminal block accommodation chamber by installing and removing the cover member. The terminal block has a plurality of feeding terminals to which leads drawn through an introduction port in the cover member are connected. A plurality of plug-shaped contact shoes for electric connection are attached to the respective terminals. Socket-shaped contact shoes leading to the solenoid valve are provided in a first connector installed inside the terminal block accommodation chamber. When the solenoid is inserted into the accommodation chamber, the contact shoes of the terminal block are connected to the contact shoes of the first connector.

6 Claims, 8 Drawing Sheets

FIG.8
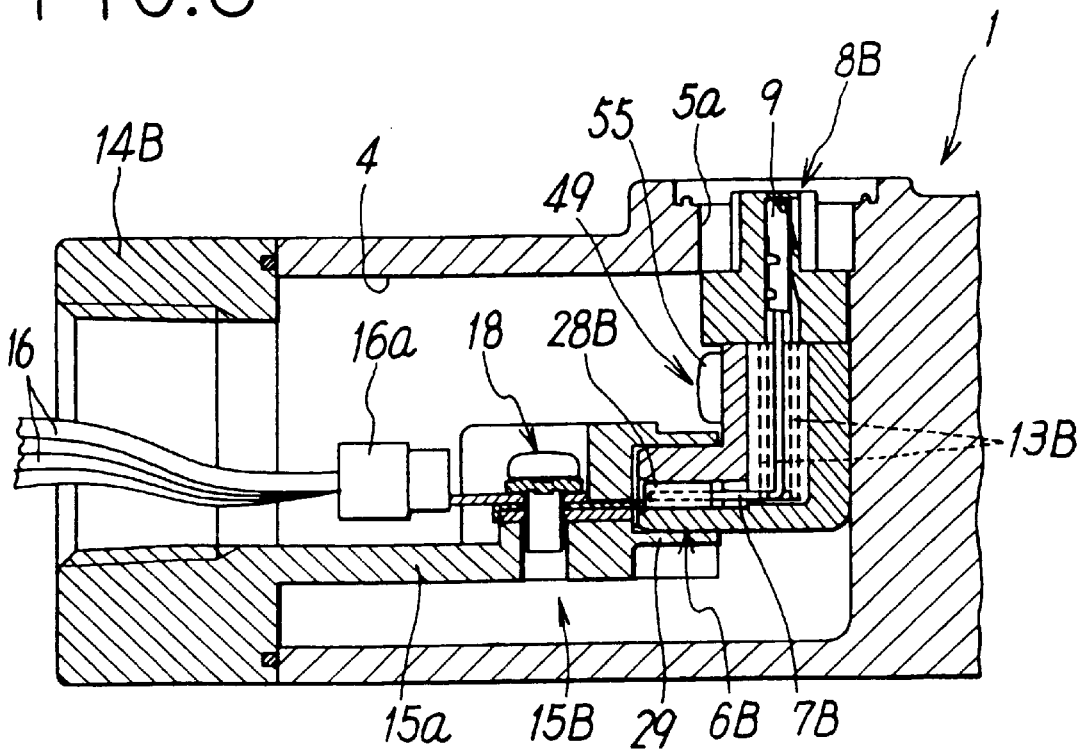
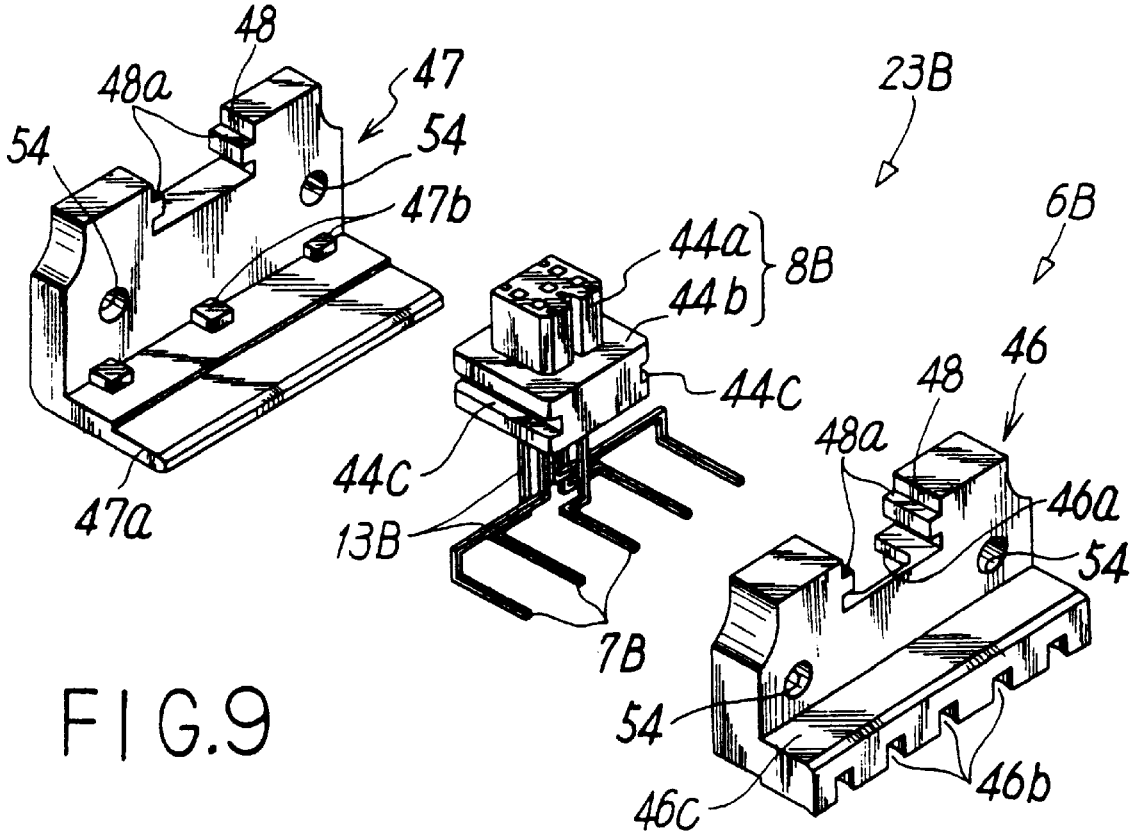
FIG.9

WIRE CONNECTION APPARATUS FOR SOLENOID-OPERATED VALVES

This application is a continuation of Ser. No. 09/205,363 filed Dec. 4, 1998, now U.S. Pat. No. 6,017,249.

FIELD OF THE INVENTION

The present invention relates to a wire connection apparatus for connecting feeding leads from an external power supply to a solenoid valve installed on a valve installation member such as a sub-plate or a manifold.

PRIOR ART

An example of a known wire connection apparatus for connecting feeding leads to a solenoid valve installed on a valve installation member, such as a sub-plate or a manifold, is a plug-in feeding apparatus in which a solenoid valve is installed on the valve installation member so that a receiving connector provided in the solenoid valve is electrically connected to a connector to a terminal block mounted on the valve installation member.

FIG. 11 shows an example of a well-known plug-in feeding apparatus. A valve installation member 61 having a solenoid-operated valve installed on its top surface includes a terminal block 62 mounted at one longitudinal end and a cover 63 covering the terminal block. The terminal block 62 has a plurality of feeding terminals 64 to which leads (not shown) are connected, and the cover 63 has an introduction hole 63*a* through which the leads are introduced.

When the solenoid-operated valve 60 is installed on the valve installation member 61, the pins in a receiving terminal (not shown) provided in the solenoid valve are electrically connected to a connector (not shown) provided in a terminal block.

In this well-known feeding apparatus, when the leads, which have been passed through the introduction hole 63*a* in the cover 63, are connected to the plurality of feeding terminals 64 provided in the terminal block 62 and if an attempt is made to perform this connection operation when the solenoid-operated valve 60 is installed on the valve installation member 61, the operation must be performed in a narrow space under the solenoid valve 60 and is thus difficult. Consequently, the connection of the leads and the replacement of the terminal block are cumbersome, and the reliability of the connections is low.

OBJECTS OF THE INVENTION

It is an object of this invention to provide a wire connection apparatus that is reliable and safe for use in feeding electricity and that enables feeding leads to be connected simply, reliably, and safely to a solenoid valve that is placed on the valve installation member.

To achieve this object, this invention provides a wire connection apparatus comprising a terminal block accommodation chamber in a valve installation member, a cover member detachably mounted on the opening of the terminal block accommodation chamber, and a terminal block that is formed integrally with the cover member and that is loaded in and unloaded from the terminal block accommodation chamber when the cover is installed and removed, respectively.

An introduction port through which feeding leads are drawn is provided in the cover member, and a plurality of feeding terminals to which the drawn leads are connected are provided on the terminal block. A plurality of contacts extend from the respective terminals, and a plurality of contacts leading to a solenoid-operated valve are provided in a first connector installed in the terminal block accommodation chamber so that when the terminal block is inserted into the accommodation chamber, the contacts of the terminal block and the contacts of the first connector are connected together.

In this invention configured in the above manner, the cover member is removed from the valve installation member to remove the terminal block from the accommodation chamber, and the feeding leads inserted into the introduction port in the cover member are connected to the respective feeding terminals. Subsequently, when the cover member is mounted on the opening of the accommodation chamber, the terminal block is inserted into the accommodation chamber to connect the contacts of the terminal block and the contacts of the first connector together, and the solenoid valve is connected to the feeding leads via the terminal block and first connector.

Thus, according to this invention, since the leads can be connected to the respective feeding terminals of the terminal block in a space outside the terminal accommodation chamber, connection operations can be simply and reliably performed even if the solenoid valve is installed on the valve installation member.

In addition, since each feeding terminal and the first connector are automatically connected together by inserting the wire-connected terminal block into the terminal block accommodation chamber, connection operations are simple and no connection error occurs. Electrical reliability is therefore improved.

Moreover, the terminal block can be loaded and unloaded via the cover member by simply installing and removing the cover member. Thus, handling is simple and this apparatus is safe because the operator does not need to directly touch the terminal block.

According to one specific embodiment of this invention, the terminal block has a base extending from behind the cover member. The plurality of feeding terminals are provided on the tip of the base horizontally in parallel. In addition, the contacts of the terminal block and the contacts of the first connector are shaped like plugs and sockets, respectively, that can be fitted together. The contacts of the terminal block are entirely surrounded by a cylindrical protective frame having an open front surface, and the contacts of the first connector are disposed horizontally in parallel inside a connector body mounted in the valve installation member. When the tip of the first connector is fitted in the protective frame, the contacts are connected together.

According to another specific embodiment, a second connector electrically connected to the first connector is provided on the top surface of the valve installation member so that when the solenoid is placed on the valve installation member, the connector of the solenoid valve is connected to the second connector.

BRIEF DESCRIPTION OF THE DRAWINGS

FIG. 8 is a sectional view of a connected state of the third embodiment.

FIG. 9 is a perspective view of the third embodiment in a partly exploded form.

DETAILED DESCRIPTION

Figure 1:
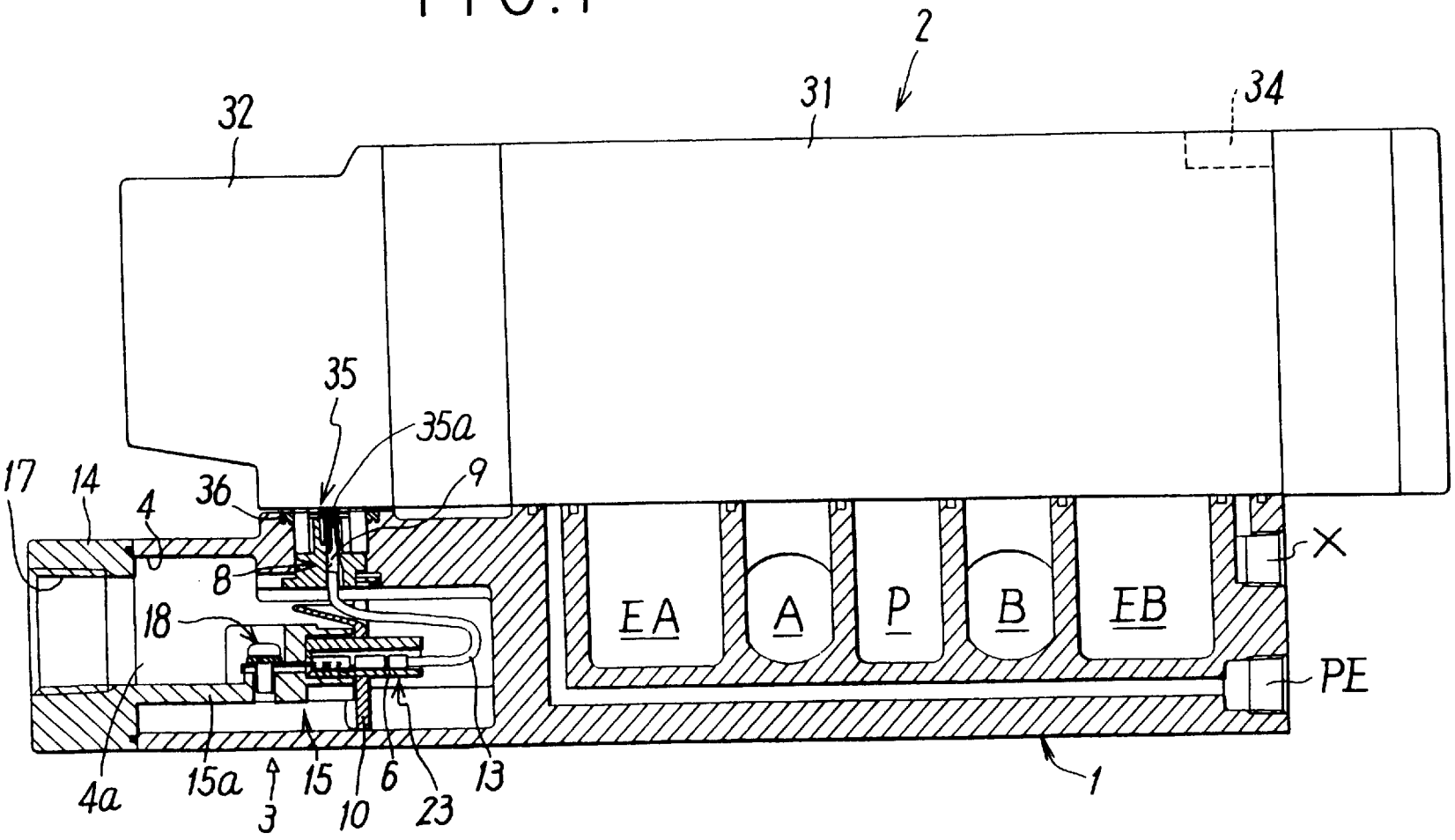
FIG. 1 is a sectional view of the integral part of a first embodiment of this invention.
Figure 2:
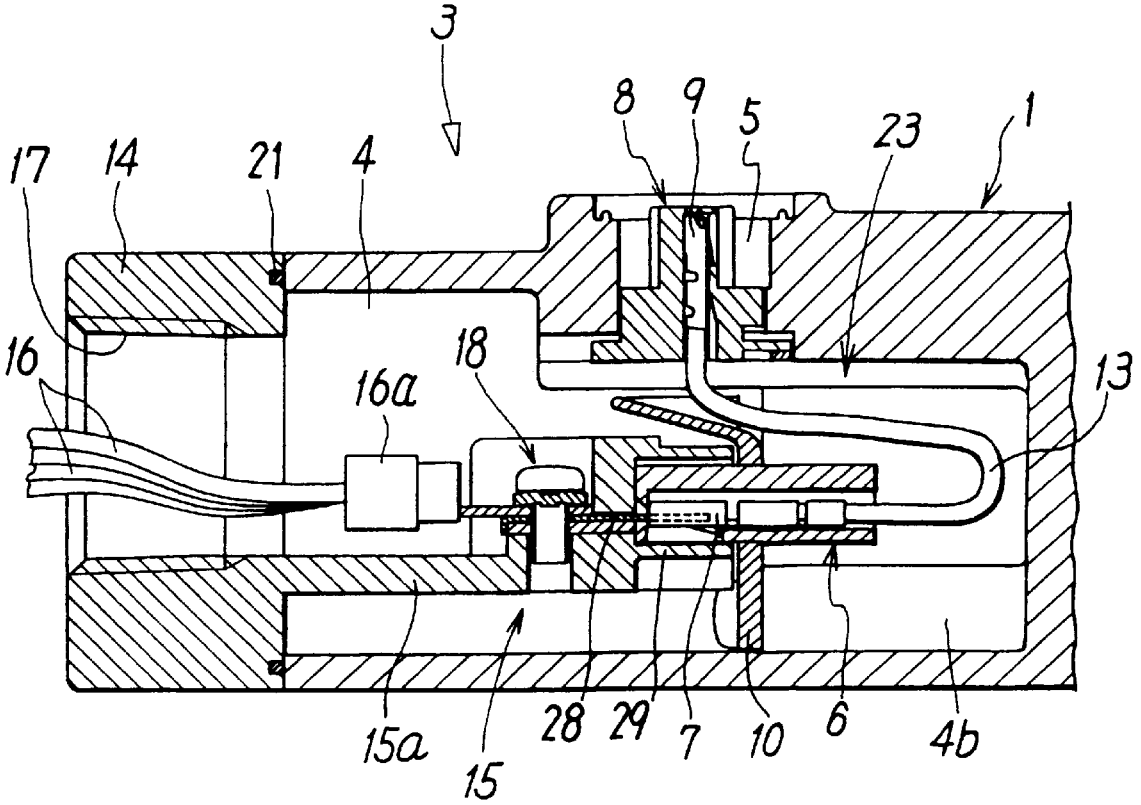
FIG. 2 is an enlarged view of the integral part in FIG. 1 showing that leads are connected to the apparatus.

FIGS. 1 to 5 show a first embodiment of a wire connection apparatus according to this invention. A wire connection apparatus 3 is provided at one end of a sub-plate, which is an example of a valve installation member, and power is fed to a solenoid valve 2 on the sub-plate 1 via the connection apparatus 3.

The sub-plate 1 comprises a supply port P and ejection ports EA and EB for a pressure fluid that are opened toward the reader, output ports A and B for a pressure fluid that are opened in the direction opposite to the reader, and an external pilot supply port X and a pilot ejection port PE that are opened in an end surface opposite to the connection apparatus 3. Each of these ports is opened in a solenoid-operated valve installation surface of the sub-plate 1.

The connection apparatus 3 has a terminal block accommodation chamber 4 formed at one end of the sub-plate 1, a cover member 14 detachably mounted on an opening 4*a* in the front surface of the accommodation chamber 4, a terminal block 15 formed integrally with the cover member 14, and a relay connection means 23 for electrically connecting the terminal block 15 and the solenoid-operated valve 2.

The terminal block accommodation chamber 4 is formed in such a way as to have the opening 4*a* in one end surface of the sub-plate 1, and the relay connection means 23 is accommodated inside the terminal block accommodation chamber 4 beforehand. The relay connection means 23 consists of a first connector 6 electrically connected to the terminal block 15, a second connector 8 connected to the solenoid-operated block 2, and a lead 13 that is a conductive member for electrically connecting connectors 6 and 8 together.

Figure 5:
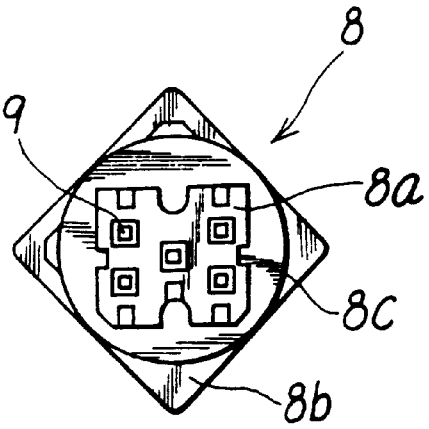
FIG. 5 is a top view of a second connector.

The second connector 8 is provided upward in the connector accommodation chamber 5, which is opened in the top surface of the sub-plate 1. As shown in FIG. 5, the second connector 8 comprises a main body section 8*a* that appears to be almost square from above and that is inserted into the opening 5*a* of the connector accommodation chamber 5; a mounting section 8*b* that is larger than the main body section, that appears to be almost square from above, and that is engagingly locked in a connector mounting groove 5*b*; and a cylindrical portion 8*c* located between the main body section and the mounting section. The second connector is mounted in the connector accommodation chamber 5 by inserting it into the chamber 5 from the terminal block accommodation chamber side 4 and rotating it through about 45° to engagingly lock the corners of the mounting section 8*b* in the connector mounting groove 5*b*. The second connector 8 has a plurality of socket terminals 9 in which pin-shaped terminals 35*a* are provided on a receiving connector 35 of the solenoid valve 2.

The first connector 6 is held by a mounting plate 10 that is fixed to a protrusion 4*b* in the rear of the terminal block accommodation chamber 4 using a plurality of set screws 10*a*. In the first connector 6, a contact 28 extending from each feeding terminal 18 of the terminal block 15 and a plurality of contacts 7 shaped like connectable sockets are provided horizontally in parallel, and each contact 7 and each socket terminal 9 of the second connector 8 are connected together via the lead 13.

The terminal block 15 is formed integrally with the cover member 14 so as to be loaded in and unloaded from the terminal block accommodation chamber 4 by mounting it on and removing it from the accommodation chamber 4, respectively. The terminal block 15 has a base 15*a* extending from behind the cover member 14, and the feeding terminals 18 shaped like screws are provided on the tip of the base 15 horizontally in parallel so that feeding leads 16 drawn through a lead introduction port 17 in the cover member 14 are connected to these feeding terminals 18.

Each feeding terminal 18 has a nut 25 into which the terminal is screwed and a washer 26 located between the terminal and the nut. The plug-shaped contact 28 for electric connection is attached to each feeding terminal 18 in such a way as to extend outward, and the contacts 28 are entirely surrounded by a cylindrical protective frame 29 having an open front surface. With the tip of the connector 6 fitted in the protective frame 29, each plug-shaped contact 28 is fitted in the corresponding socket-shaped contact shoe 7 of the first connector 6 for connection.

In addition, the cover member 14 comprises two positioning protrusions 19 formed at diagonal positions, two bolt through-holes 20, and a seal member 21 for sealing the periphery of the opening 4*a* of the terminal block accommodation chamber 4. The cover member 14 can be mounted on the sub-plate 1 by inserting the positioning protrusions 19 into positioning holes provided in the sub-plate 1 to determine a mounting position, and tightening set screws 22 passing through the bolt through-holes 20.

The solenoid-operated valve 2 installed on the sub-plate 1 is a pilot-type 5-port directional control valve. The solenoid-operated valve 2 comprises a main valve 31, a solenoid-driven pilot valve 32, and an amplifying valve between the main valve and the pilot valve. In addition, changing the mounting position of the switching plate 34 enables a pilot fluid supplied to the pilot valve 32 to be switched between an internal pilot fluid supplied from the supply port P and an external pilot fluid supplied from the external pilot supply port X. The plug-in receiving connector 35 having a plurality of (in the illustrated example, 5) pin-shaped connection terminals 35*a* is provided on the bottom surface of the pilot valve 32.

When the solenoid valve 2 is installed on the sub-plate 1 via a gasket, each port provided in the solenoid valve 2 communicates with the opening of a corresponding port in the sub-plate 1 in an airtight manner, and the plurality of pin-shaped terminals 35*a* of the receiving connector 35 are each inserted into the socket terminal 9 of the second connector 8 for electric connection.

The solenoid-operated valve 2 is not limited to a pilot-type 5-port directional control valve.

Figure 4:
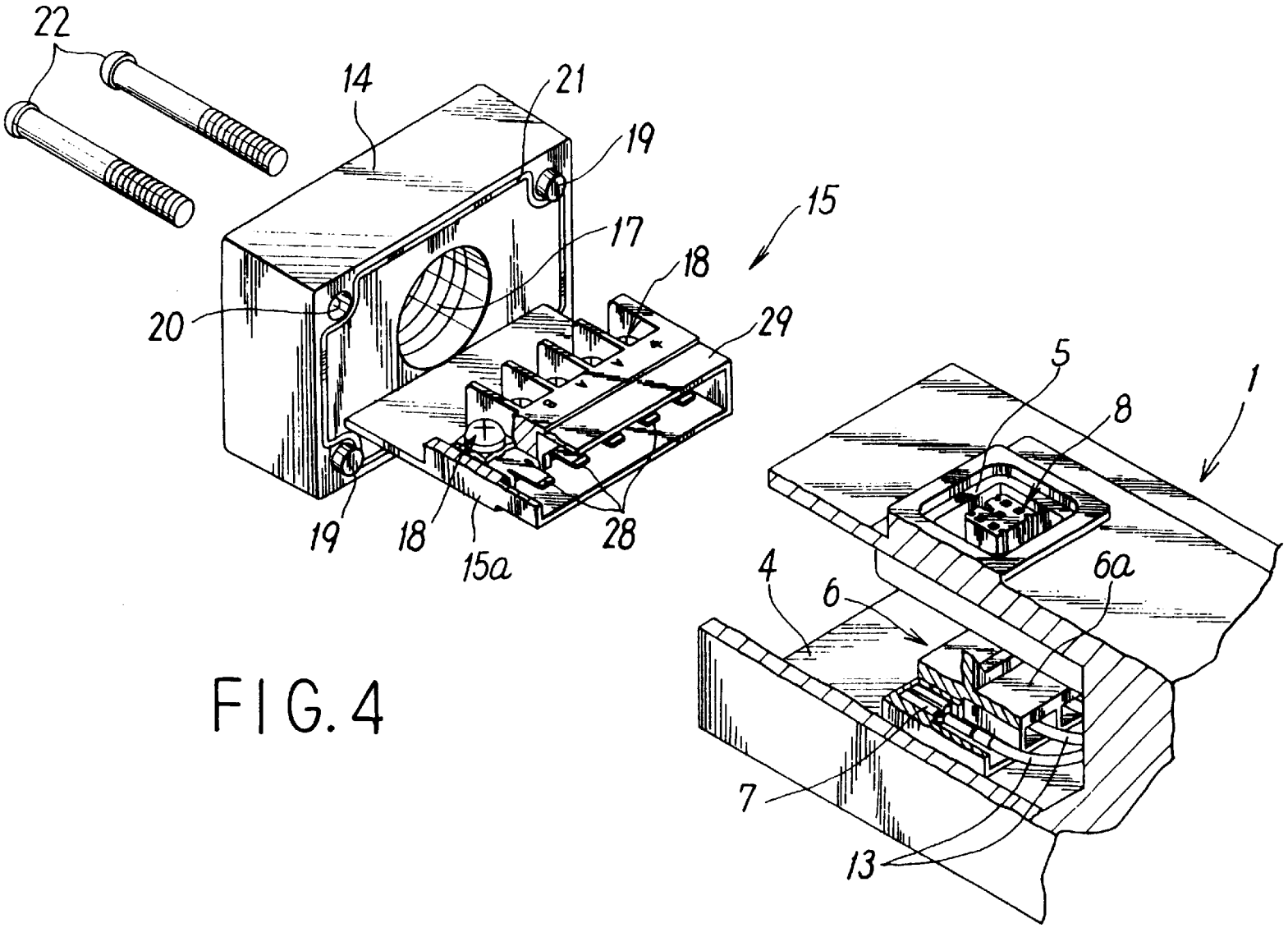
FIG. 4 is a perspective view of FIG. 3 in a partly exploded form.

Reference numeral 36 in FIG. 4 designates a seal member that seals the connection portion between the receiving connector 35 and the second connector 8 and that is fitted and mounted around the opening of the connector accommodation chamber 5.

The valve installation member according to this invention is not limited to the sub-plate 1 but may be a manifold instead.

Figure 3:
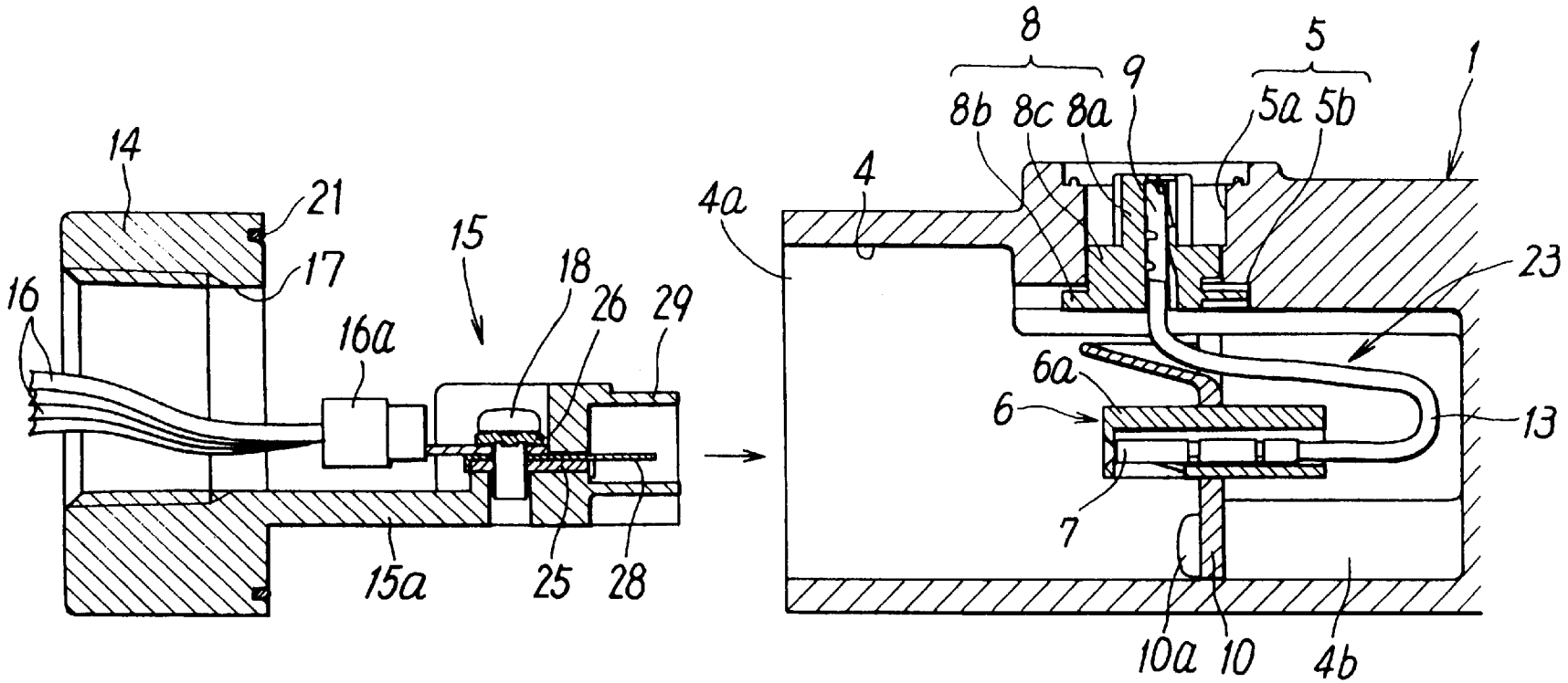
FIG. 3 is a sectional view showing that a terminal block is removed.

According to the first embodiment, when the feeding leads 16 from an external power supply are connected to the terminal block 15, the cover member 14 is removed to draw the terminal block 15 from the accommodation chamber 4, and the leads 16 drawn through the introduction port 17 in the cover member 15 to the terminal block 15 are each connected to the respective feeding terminal 18 with or without a crimp terminal 16*a*, as shown in FIGS. 3 and 4.

As a result, the leads 16 can be connected in a space outside the terminal block accommodation chamber 4, so this connection operation is easy even if the solenoid-operated valve 2 is mounted on the sub-plate 1 beforehand.

When the terminal block 15 to which the leads 16 are connected is accommodated in the terminal block 15 and the cover member 14 is fixed to the opening 4*a* of the accommodation chamber 4, the plug-shaped contact 28 extending from each feeding terminal 18 of the terminal block 15 is automatically fitted in the corresponding socket-shaped contact 7 of the first connector 6 for electric connection. Then, the tip of the first connector 6 is fitted in the protective frame 29 at the tip of the terminal block 15.

Thus, the leads 16 can be connected to the respective feeding terminals 18 very easily. In addition, since the terminal block 15 can be loaded in and unloaded from the terminal block accommodation chamber 4 by simply opening and closing the cover member 14, respectively, the operator does not need to directly touch the terminal block. Therefore, the safety of this apparatus is improved. Moreover, by simply pressing the terminal block 15 into the accommodation chamber 4 using the cover member 14, the terminal block 15 to which the leads 16 are connected can be automatically connected to the first connector 6 leading to the solenoid-operated valve 2. Consequently, the connection operation is simple and is not subject to connection errors.

Figure 6:
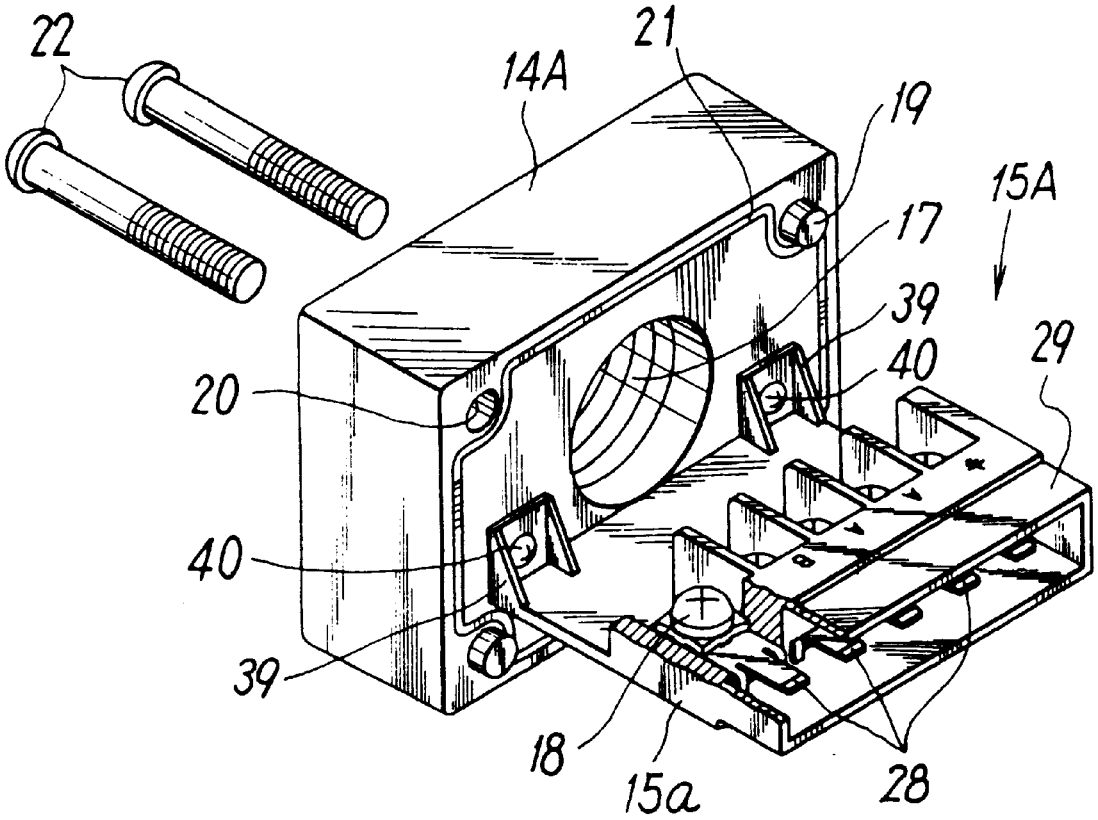
FIG. 6 is a perspective view of the integral part of a second embodiment of this invention.
Figure 7:
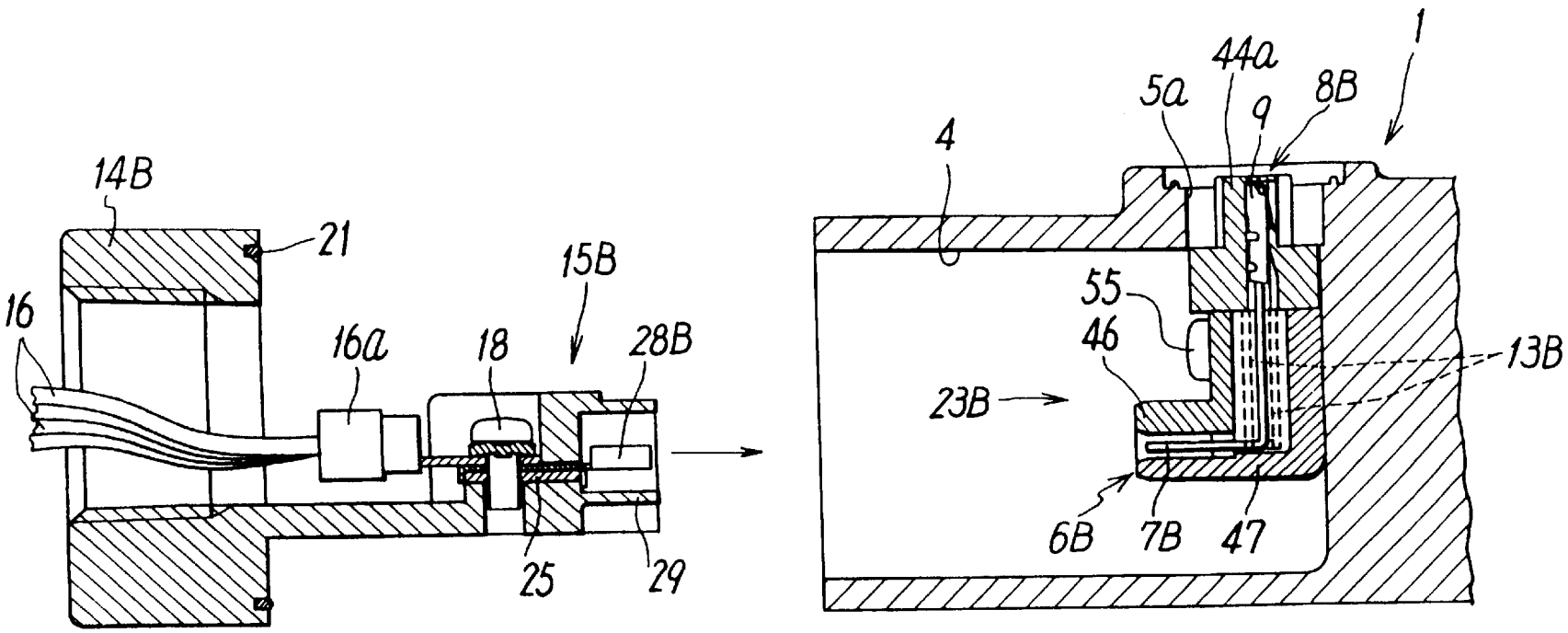
FIG. 7 is a sectional view of a separated state showing a third embodiment of this invention.
Figure 10:
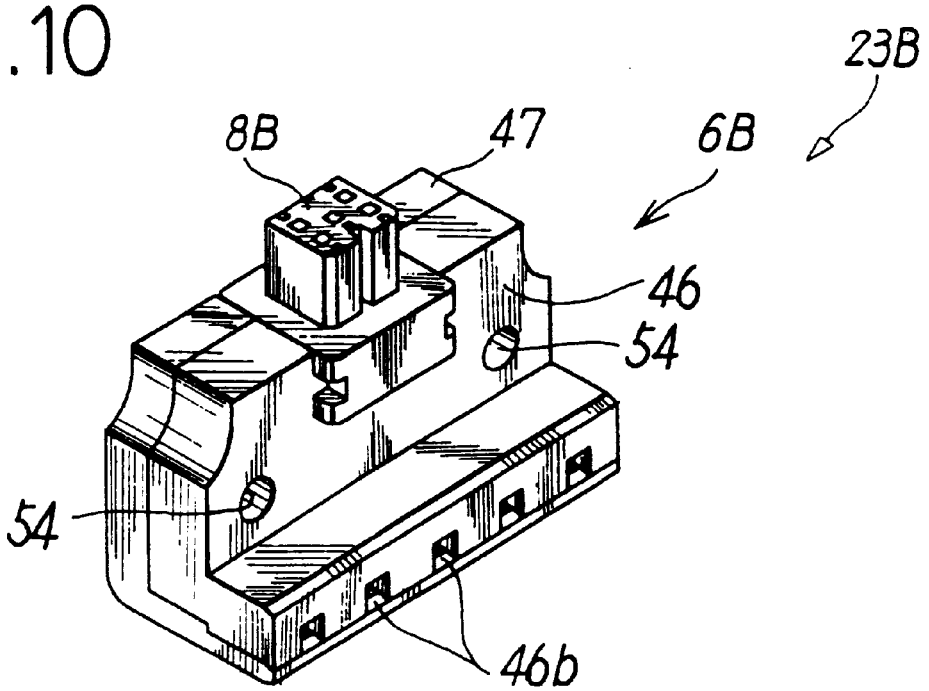
FIG. 10 is a perspective view showing that the components in FIG. 9 are integrally assembled together.
Figure 11:
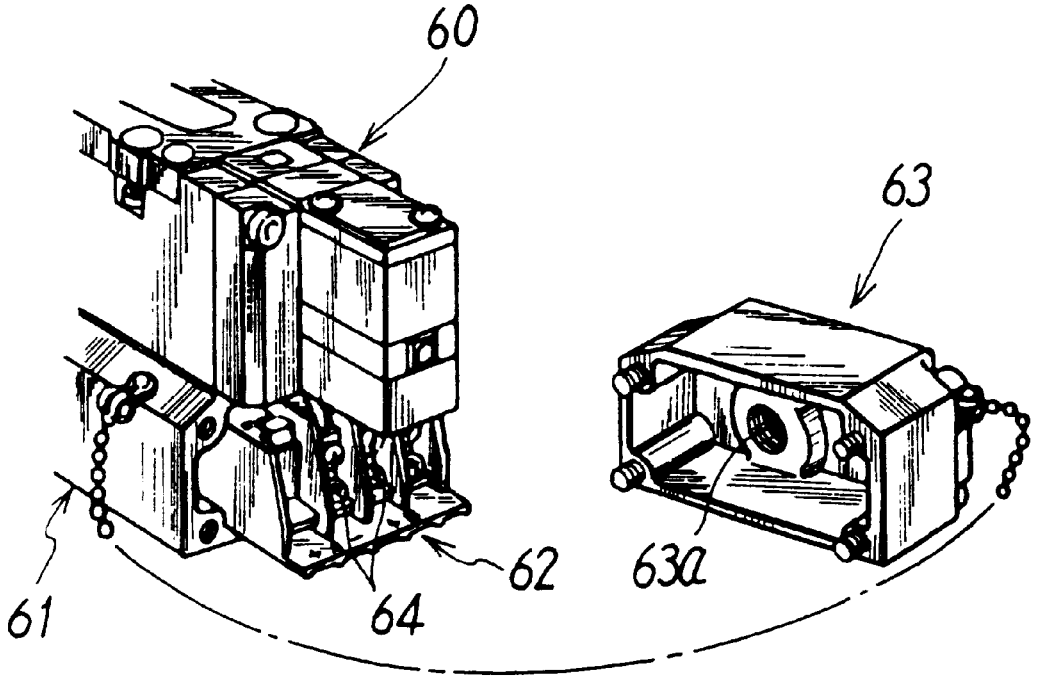
FIG.11 PRIOR ART
FIG. 11 is a perspective view of the integral part of a well-known feeding apparatus.

FIG. 6 shows a cover member 14A and a terminal block 15A according to a second embodiment. Although in the first embodiment the cover member 14 and the base 15*a* of the terminal block 15 are integrated, in the second embodiment the base 15*a* of the terminal block 15A is formed separately from the cover member 14A and these components are coupled together using screws 40 passing through mounting sections 39.

The other configuration is the same as in the first embodiment, so the same components have the same reference numerals and their description is omitted.

By forming the terminal block 15A and the cover member 14A separately and coupling them together, these components can be manufactured easily.

In this case, the leads may be connected to the respective feeding terminals 18 with the terminal block 15A coupled to the cover member 14A. Alternatively, the leads may be connected with the terminal block 15A separated from the cover member 14A, followed by the mounting of the terminal block 15A on the cover member 14A.

FIGS. 7 to 10 show a third embodiment of this invention. The third embodiment differs from the first embodiment in that each contact 28B in a terminal block 15B is shaped like a socket while each contact 7B in a first connector 6B is shaped like a plug, resulting in a slight difference in the configuration of the relay connection means.

That is, a second connector 8B in the relay connection means 23B comprises a main body section 44*a* that appears to be square from above, a base 44*b* having a larger diameter than the main body section, and engagement grooves 44*c* in two opposed sides of the base 44*b*.

A first connector 6B has a first body 46 and a second body 47 each having an L-shaped cross section. A recessed portion 48 in which the base 44*b* of the second connector 8 is fitted is formed in the middle of the upper end of each body 46 or 47, and the recessed portion 48 includes a protrusion 48*a* that is engaged with the engagement groove 44*c*. A plurality of pin-shaped contacts 7B are provided between the bodies 46 and 47, and are connected to the socket terminal 9 in the second connector 8B via conductive members 13B integrated with the contacts 7B.

In addition, the first body 46 has a notch 46*a* through which a perpendicularly extending portion of each conductive member 13B passes, and also has, in its horizontal portion 46*c*, a plurality of grooves 46*b* in which each contact 7B, which is formed by bending each conductive member 13B in the horizontal direction, is fitted. The second body 47 comprises a horizontal portion 47*a* located under the horizontal portion 46*c* of the first body 46 to cover the openings of the grooves 46*b*, and a plurality of protrusions 47*b* for reinforcing and positioning.

The tip of the contact shoe 28B connected to each feeding terminal 18 of the terminal block 15B is shaped like a socket into which the corresponding contact 7B of the first connector 6B can be inserted.

By accommodating a relay connection means 23B according to this invention in the terminal block accommodation chamber 4 and accommodating the main body section 44*a* of the second connector 8B in the connector accommodation chamber 5*a*, the relay connection means 23B can be mounted on the rear wall of the terminal block accommodation chamber 4 using set screws 55 passing through a plurality of through-holes 54 provided in the first and second bodies 46 and 47. In this case, since the first connector 6B and the second connector 8B are coupled together, they enable easy mounting on the sub-plate 1.

The remaining configuration and operation of the third embodiment are substantially the same as those in the first embodiment, so the same major components have the same reference numerals and their description is omitted.

Of course, in the third embodiment, the cover member 14B and the terminal block 15B may be separately formed and subsequently coupled together.

What is claimed are:

1. A connection apparatus for connecting feeding leads from an external power supply to a solenoid valve installed on a valve installation member, comprising:

a terminal block accommodation chamber formed on said valve installation member;

a cover member detachably mounted on an opening of said terminal accommodation chamber and including an introduction port through which said feeding leads are drawn into the accommodation chamber;

a terminal block integrally formed with said cover member and comprising a plurality of feeding terminals to which the feeding leads are connected and a plurality of contacts extending from each of said feeding terminals for electric connection;

a first connector inside said terminal block accommodation chamber and having a plurality of contacts that are each connected to the contacts in said terminal block when the terminal block is inserted into the accommodation chamber; and means for electrically connecting said first connector to the solenoid-operated valve.

2. A connection apparatus according to claim 1, wherein the means for connecting said first connector to the solenoid valve comprises a second connector provided on a top surface of the valve installation chamber and a plurality of conductive members that electrically connect a plurality of socket terminals of the second connector to each contact of said first connector, and wherein when the solenoid is placed on said valve installation member, the connector of the solenoid valve is connected to said second connector.

3. A connection apparatus according to claim 2, wherein the second connector has a plurality of socket terminals in which pin-shaped terminals are provided on a receiving connector of said solenoid valve.

4. A connection apparatus according to claim 1, wherein said first connector is held in place by a mounting plate that is fixed to a protrusion in a rear of said terminal block accommodation chamber.

5. A connection apparatus according to claim 1, wherein said cover member further comprises two positioning protrusions formed at diagonal positions and a seal member for sealing the periphery of said opening of the terminal block accommodation chamber.

6. A connection apparatus according to claim 1, wherein said terminal block and the cover member are separately formed.

* * * * *